US008141874B2

(12) United States Patent
Fukuda et al.

(10) Patent No.: US 8,141,874 B2
(45) Date of Patent: Mar. 27, 2012

(54) SHEET CONVEYING APPARATUS AND IMAGE FORMING APPARATUS PROVIDED WITH THE SAME

(75) Inventors: Masayuki Fukuda, Susono (JP); Kenji Ninomiya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 2 days.

(21) Appl. No.: 12/754,042

(22) Filed: Apr. 5, 2010

(65) Prior Publication Data

US 2010/0187756 A1 Jul. 29, 2010

Related U.S. Application Data

(63) Continuation of application No. 11/359,409, filed on Feb. 23, 2006, now Pat. No. 7,699,312.

(30) Foreign Application Priority Data

Feb. 28, 2005 (JP) ..... 2005-053582

(51) Int. Cl.
*B65H 39/10* (2006.01)

(52) U.S. Cl. ..... 271/303; 271/301; 399/405

(58) Field of Classification Search ..... 271/303, 271/301; 399/405
See application file for complete search history.

(56) References Cited

U.S. PATENT DOCUMENTS

| | | | | |
|---|---|---|---|---|
| 4,750,016 | A | 6/1988 | Kusumoto et al. | |
| 4,945,390 | A | 7/1990 | Hasegawa et al. | |
| 5,184,734 | A | 2/1993 | Yamaguchi | |
| 5,237,381 | A | 8/1993 | Hamada | |
| 5,553,528 | A | 9/1996 | Zoltner | |
| 5,586,758 | A | 12/1996 | Kimura et al. | |
| 5,862,435 | A | 1/1999 | Suzumi et al. | |
| 6,332,611 | B1 * | 12/2001 | Tomita | 271/273 |
| 6,953,192 | B2 | 10/2005 | Jang | |
| 7,079,806 | B2 | 7/2006 | Baek et al. | |
| 7,448,621 | B2 | 11/2008 | Yasumoto | |

FOREIGN PATENT DOCUMENTS

| | | |
|---|---|---|
| JP | 4-16456 | 1/1992 |
| JP | 4-46066 | 4/1992 |
| JP | 5-24732 | 2/1993 |
| JP | 5-51160 | 3/1993 |
| JP | 8-217312 | 8/1996 |
| JP | 9-194106 | 7/1997 |
| JP | 9-278252 | 10/1997 |
| JP | 10-35981 | 2/1998 |
| JP | 2001-341919 | 12/2001 |
| JP | 2002-145504 | 5/2002 |

* cited by examiner

*Primary Examiner* — Michael McCullough
*Assistant Examiner* — Luis A Gonzalez
(74) *Attorney, Agent, or Firm* — Fitzpatrick, Cella, Harper & Scinto

(57) ABSTRACT

A sheet conveying apparatus has a pair of conveying rotary members for conveying a sheet, an openable and closable conveying guide for guiding the sheet conveyed by the pair of conveying rotary members, a conveying path, which is disposed on a downstream side of the conveying guide, on which the sheet guide passes, a discharging portion on which the sheet having passed on the conveying path and discharged is stacked, and an obstructing member for obstructing the entrance of the conveying path. In a state in which the conveying guide is closed, the sheet conveyed by the pair of conveying rotary members is guided to the conveying path by the conveying guide. In a state in which the conveying guide is closed, the obstructing member is retracted from the entrance of the conveying path, and in a state in which the conveying guide is opened, the obstructing member obstructs the entrance of the conveying path.

7 Claims, 12 Drawing Sheets

SHEET CONVEYING APPARATUS AND IMAGE FORMING APPARATUS PROVIDED WITH THE SAME

This application is a continuation of U.S. patent application Ser. No. 11/359,409, filed Feb. 23, 2006, and allowed on Dec. 1, 2009.

BACKGROUND OF THE INVENTION

1. Field of the Invention

This invention relates to a sheet conveying apparatus for conveying a sheet, and an image forming apparatus provided with the sheet conveying apparatus.

2. Related Background Art

Among conventional image forming apparatuses, there are image forming apparatuses in which the discharging direction of a recording medium after image fixing can be changed over to thereby effect face-down discharge and face-up discharge. Such image forming apparatuses are described, for example, in Japanese Patent Application Laid-open No. H09-278252, Japanese Patent Application Laid-open No. 2002-145504 and Japanese Patent Application Laid-open No. 2001-341919. The image forming apparatuses of such construction include a construction as shown in Japanese Patent Application Laid-open No. H09-278252 and Japanese Patent Application Laid-open No. 2002-145504 wherein a plurality of pairs of rollers are provided downstream of a rockable guide provided downstream of a fixing device, and a construction as shown in Japanese Patent Application Laid-open No. 2001-341919 wherein only one pair of rollers are provided. An example of this construction will hereinafter be described with reference to FIGS. 11A and 11B of the accompanying drawings. In the following, description will be made of a construction in which a plurality of pairs of rollers are provided downstream of a rockable guide.

There is an image forming apparatus which effects discharge in a face-down state (hereinafter referred to as the face-down discharge) in which as shown in FIG. 11A, a surface on which an image is formed becomes the lower side of a recording medium, and discharge in a face-up state (hereinafter referred to as the face-up discharge) in which the surface on which an image is formed becomes the upper side of the recording medium. The image forming apparatus which effects the face-down discharge and the face-up discharge has a stacking surface 109 for stacking recording mediums thereon with the image-formed surfaces thereof in the face-down state, and a tray 111 for stacking the recording mediums thereon with the image-formed surfaces thereof in the face-up state. Also, a pair of conveying rollers 106 and pairs of rollers 107 and 108 are disposed downstream of a fixing portion for effecting image fixing with respect to a recording medium conveying direction.

In case of the face-down discharge of the recording medium, the tray 111 is closed as shown in FIG. 11A. A conveying guide 110 is closed in operative association with this. The recording medium is conveyed to the pair of rollers 107 and the pair of rollers 108 while being guided by the conveying guide 110. In this process, the upper surface and lower surface of the recording medium are reversed and the recording medium is stacked on the stacking surface 109 with the image-formed surface facing down.

In case of the face-up discharge of the recording medium, the tray 111 is opened as shown in FIG. 11B. The conveying guide 110 is opened in operative association with this. Thereby, the conveying guide 110 is spaced apart from the pair of conveying rollers 106 and therefore, the recording medium is conveyed without being guided by the conveying guide 110, and the recording medium is stacked on the tray 111 with the surface thereof having an image formed thereon facing up.

According to the above-described art, however, when in the face-up discharge of the recording medium, the recording mediums are stacked with the surfaces thereof having images formed thereon facing up, there has been the following problem. In FIGS. 12A to 12C, a recording medium Pt designates the uppermost one of the recording mediums stacked on the conveying guide 110 and the tray 111. Also, a recording medium Pn denotes a recording medium conveyed from the pair of conveying rollers 106 to the conveying guide 110 and the tray 111.

Depending on the ambient environment, there is a case where as shown in FIG. 12A, the recording medium Pt is discharged with its trailing edge flexed upwardly. When the next recording medium Pn is discharged from the pair of conveying rollers 106, there is a case where as shown in FIG. 12B, the lower surface of the trailing edge of the recording medium Pt and the upper surface of the leading edge of the recording medium Pn contact with each other. When as shown in FIG. 12C, the recording medium Pn is upwardly conveyed by the conveying force of the pair of conveying rollers 106, there is the possibility that the recording medium Pn may abuts against the nip portion between the pair of discharging rollers 107, whereby the smooth discharge of the recording medium may be hindered. As the result, there is also the possibility that discharge not intended by a user may be effected or jam may occur due to the discharge of the recording medium.

Also, even in a construction wherein the pair of rollers 107 are absent and only one pair of rollers are provided on the most downstream side of a conveying path, when the trailing edge of the recording medium Pt and the recording medium Pn enter a conveying path 116, there is the possibility that the smooth discharge of the recording medium may be hampered.

SUMMARY OF THE INVENTION

It is an object of the present invention to secure the smooth conveyance of a sheet in a sheet conveying apparatus.

It is another object to provide a sheet conveying apparatus having a pair of conveying rotary members for conveying a sheet, an openable and closable conveying guide for guiding the sheet conveyed by the pair of conveying rotary members, a conveying path, which is disposed on a downstream side of said conveying guide, through which the sheet passes, a discharging portion on which the sheet having passed on the conveying path and discharged is stacked and an obstructing member for obstructing the entrance of the conveying path, wherein in a state in which the conveying guide is closed, the sheet conveyed by the pair of conveying rotary members is guided to the conveying path by the conveying guide, and in the state in which the conveying guide is closed, the obstructing member is retracted from the entrance of the conveying path, and in the state in which the conveying guide is opened, the obstructing member obstructs the entrance of the conveying path.

By the construction as described above, when the sheet guide is closed, the sheet guide guides the sheet to the conveying path and the obstructing member is retracted from the entrance of the conveying path. Consequently, the sheet is guided by the conveying path, and is discharged to the discharging portion. Also, when the sheet guide is opened, the obstructing member obstructs the entrance of the conveying path. Consequently, the sheet is not guided into the conveying path.

DESCRIPTION OF THE PREFERRED EMBODIMENTS

First Embodiment

A first embodiment of the present invention will hereinafter be described with reference to the drawings. In the following, after the schematic description of an image forming apparatus 20, detailed description will be made of a shutter member 12 which is a characteristic portion of the present embodiment.

(Schematic Construction of the Image Forming Apparatus 20)

Figure 1:
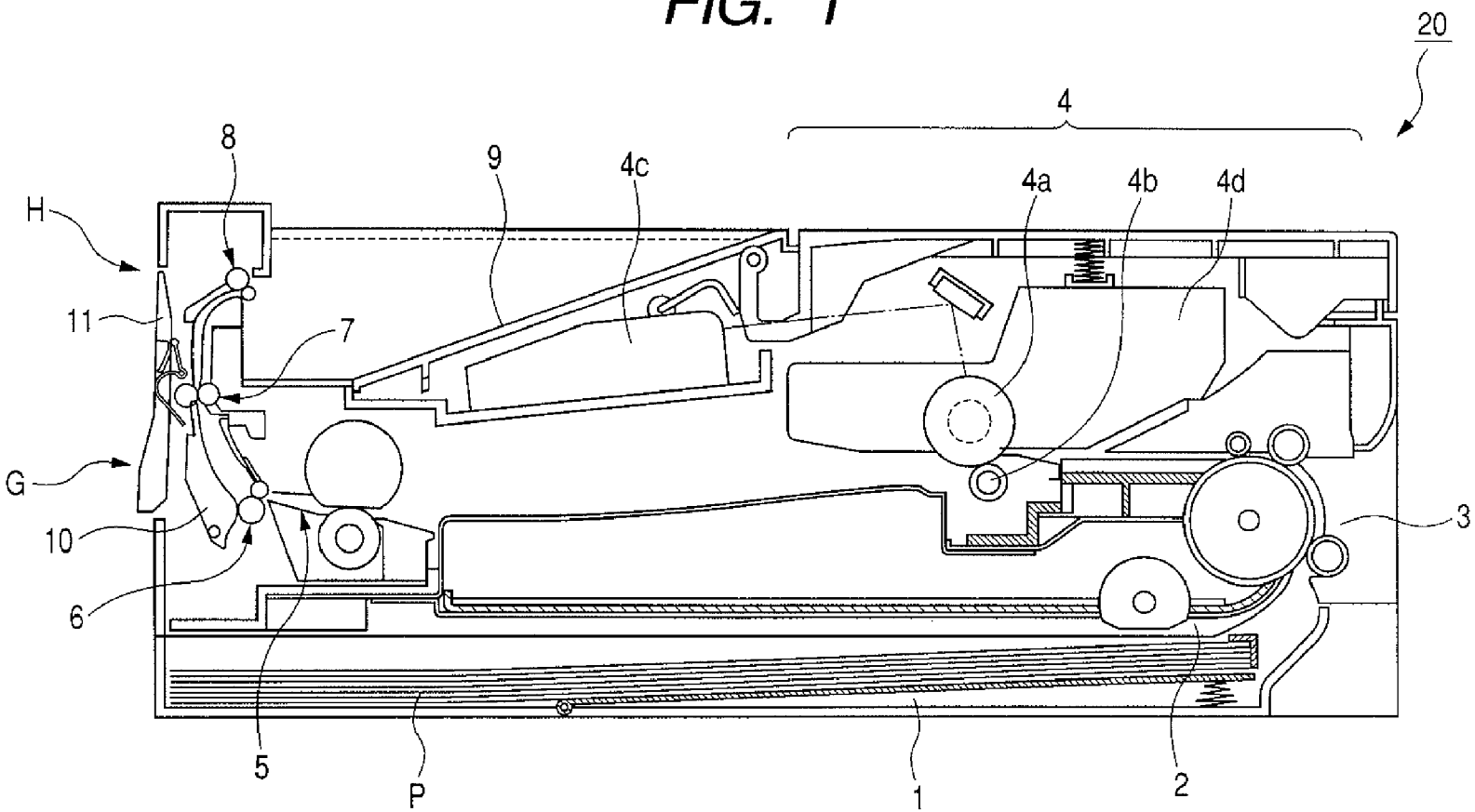
FIG. 1 is a cross-sectional view for schematically illustrating an image forming apparatus.

An example of the image forming apparatus will hereinafter be schematically described. FIG. 1 is a cross-sectional view for schematically describing the image forming apparatus 20.

As shown in FIG. 1, the image forming apparatus 20 has a feeding tray 1 on which recording mediums P as sheets are stacked, a feeding portion 2 for feeding the stacked recording mediums P one by one, a pair of feeding rollers 3 for conveying the fed recording medium P, a transferring portion 4 for transferring a toner image to the recording medium P, a fixing portion 5 for heat-fixing the toner image on the recording medium P, a first pair of conveying rollers 6 as a pair of conveying rotary members for conveying the recording medium P after fixed, a second pair of conveying rollers 7 as a second pair of conveying rotary members for conveying the recording medium P conveyed from the first pair of conveying rollers 6 to the upper surface side of a main body, a pair of discharging rollers 8 for discharging the recording medium P to the outside of the main body, a first discharging tray (first discharging portion) 9 on which the discharged recording medium P is stacked, and an openable and closable unit G for guiding the sheet from the first pair of conveying rollers 6 to the second pair of conveying rollers 7.

A sheet conveying apparatus H is incorporated in the image forming apparatus 20, and in the present embodiment, it is comprised of the first pair of conveying rollers 6, the openable and closable unit G, the second pair of conveying rollers 7, a conveying path 16, the pair of discharging rollers 8, the first discharging tray 9, etc.

The openable and closable unit G is openable and closable. When the openable and closable unit G is opened, the openable and closable unit G functions as a second discharging portion on which the discharged recording mediums P are stacked. The openable and closable unit G is constituted by two members. That is, the openable and closable unit G is constituted by a conveying guide 10 and a second discharging tray 11. The conveying guide 10 is a member for guiding the recording medium conveyed by the first pair of conveying rollers 6 to the conveying path 16 when the openable and closable unit G is closed. When the openable and closable unit G is opened, the recording mediums conveyed by the first pair of conveying rollers 6 are stacked on the conveying guide 10. Also, when the openable and closable unit is opened, the recording mediums conveyed by the first pair of conveying rollers 6 are stacked on the second discharging tray 11. That is, when the openable and closable unit G is opened, the recording mediums are stacked on both of the conveying guide 10 and the second discharging tray 11.

The transferring portion 4 has a photosensitive drum (image bearing member) 4*a* from which the toner image is transferred to the recording medium P, a transfer roller 4*b* for urging the recording medium P against the photosensitive drum 4*a*, an optical scanner 4*c* for writing an electrostatic latent image (hereinafter referred to as the laser information) onto the photosensitive drum 4*a* by a laser, and a cartridge 4*d* having the photosensitive drum 4*a* and a developing portion (not shown) for supplying a toner to the photosensitive drum 4*a*.

A shutter member 12 is disposed near the second pair of conveying rollers 7 or the entrance 16*a* of the conveying path 16. The shutter member 12 will be described later in detail.

(Flow of the Recording Medium P during Image Formation)

The recording medium P during image formation is conveyed as follows.

First, the uppermost recording medium P of the recording mediums P stacked on the feeding tray 1 is fed by the feeding portion 2, passes the pair of feeding rollers 3 and is conveyed to the transferring portion 4.

In the interior of the cartridge 4*d*, the scanner 4*c* applies a laser beam to the photosensitive drum 4*a* by an electrical signal transmitted from an electrical equipment portion, not shown, and the laser information is written onto the photosensitive drum 4*a*. A toner is supplied from the developing portion to this laser information 4*d*. Thereby, a toner image is formed on the photosensitive drum 4*a*. Therefore, when the recording medium P is conveyed to the transferring portion 4, and the transfer roller 4*b* is urged against the photosensitive drum 4*a* with the recording medium P nipped therebetween, the toner image on the photosensitive drum 4*a* is transferred to the recording medium P, and the toner image is formed on the recording medium P.

The recording medium P to which the toner image has been transferred by the transferring portion 4 comes into the fixing portion 5. The fixing portion 5 performs the function of fixing the toner image on the recording medium P and also the function as conveying means for conveying the recording medium P. The recording medium P is conveyed by the fixing portion 5. Also, in the fixing portion 5, toner particles are heat-fused to the recording medium P to thereby fix the toner image on the recording medium P.

Here, in the case of face-down discharge, the openable and closable unit G is closed and used. That is, the discharging tray 11 and the conveying guide 10 operatively associated with a discharging guide are closed. By the openable and closable unit G being brought into a closed state, the recording medium P conveyed along the guide surface of the conveying guide 10 by the first pair of conveying rollers 6 is guided to the second pair of conveying rollers 7 side. The recording medium P passes the first pair of conveying rollers 6, the second pair of conveying rollers 7 and the pair of discharging rollers 8 and is discharged onto the first discharging tray 9, and is stacked thereon. In the process of the recording material P being conveyed by the first pair of conveying rollers 6, the second pair of conveying rollers 7 and the pair of discharging rollers 8, that surface of the recording medium on which the toner image is formed is reversed upside down. Therefore, the recording medium P is discharged onto the first discharging tray with its surface having the image formed thereon facing down.

Also, in the case of face-up discharge, the openable and closable unit G is opened and used. That is, the discharging tray 11 and the conveying guide 10 are opened. By the openable and closable unit G being brought into an opened state, it never happens that the recording medium P is guided to the conveying path 16 side by the guide surface of the conveying guide 10. Accordingly, the recording medium P passes the first pair of conveying rollers 6, and thereafter is discharged onto the opened second discharging tray 11 and conveying guide 10. Here, the recording medium P is conveyed with its surface having the image formed thereon kept facing up. Therefore, the recording medium P is discharged with its surface having the image formed thereon facing up.

That is, in a state in which the openable and closable unit G (the second discharging tray 11 and the conveying guide 10) is opened, the recording medium conveyed by the first pair of conveying rollers 6 is conveyed to the sideways direction of the apparatus which is a direction differing from the conveying path 10, and is discharged onto the opened second discharging tray 11 and conveying guide 10.

(Construction of the Shutter Member 12)

The shutter member (obstructing member) 12 for smoothing the conveyance of the recording medium P onto the openable and closable unit G during face-up discharge will now be described in detail with reference to the drawings. FIGS. 2B, 4A, 4B, 5A and 5B are cross-sectional views of portions around the openable and closable unit G in the first embodiment in the face-up discharge state, and FIG. 3 is a fragmentary perspective view showing the shutter member 12 located near the entrance 16*a* of the conveying path 16 in the first embodiment. The conveying path 16 in the present embodiment is formed by a pair of guide plates.

Figure 2A:
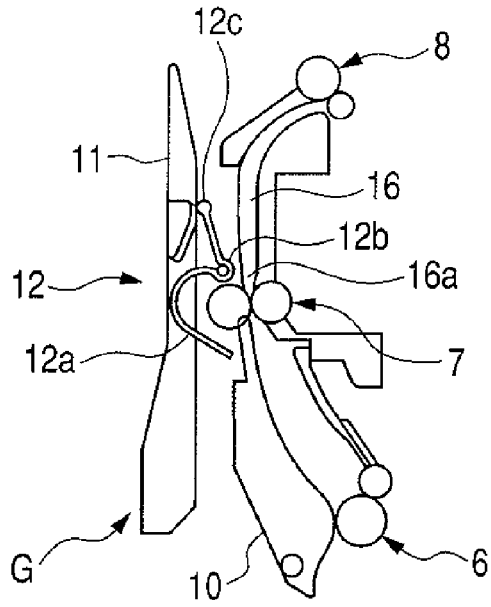
FIG. 2A is a cross-sectional view of portions around an openable and closable unit in a first embodiment in the state of face-down discharge.
Figure 2B:
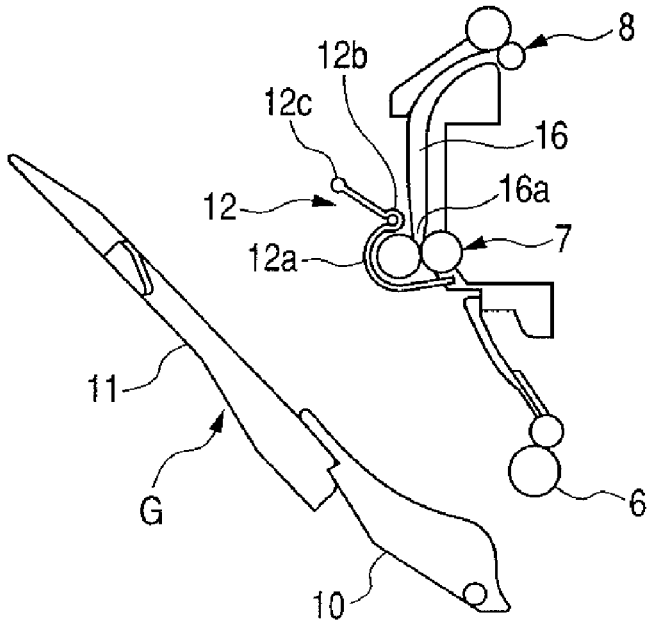
FIG. 2B is a cross-sectional view of the portions around the operable and closable unit in the first embodiment in the state of face-up discharge.
Figure 3:
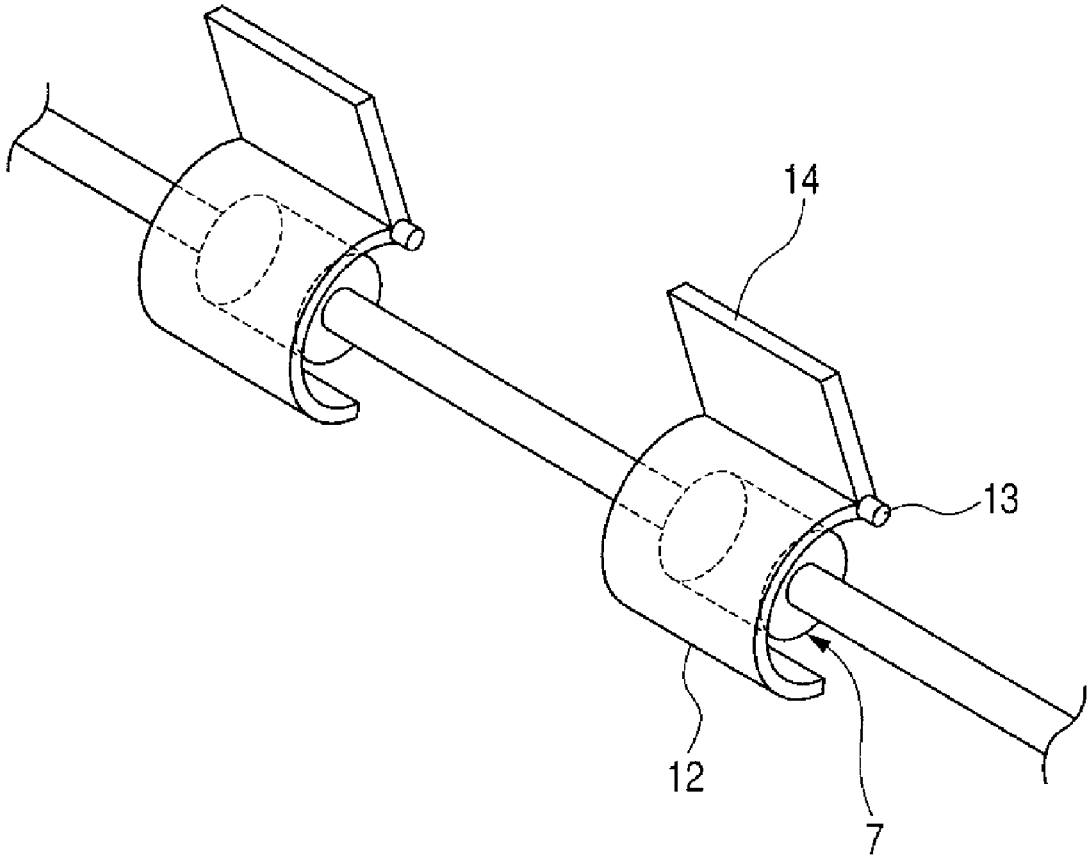
FIG. 3 is a fragmentary perspective view showing a shutter member 12 located near the entrance of a conveying path in the first embodiment.

As shown in FIGS. 2B and 3, the shutter member 12 in the present embodiment has a shutter portion (obstructing portion) 12*a* disposed so as to be capable of obstructing the conveying path 16 by covering the second pair of conveying rollers 7 and the entrance 16*a* of the conveying path 16 and having its cross section formed into a substantially C-shape (curved shape), and a pivot shaft 12*b* being at the center of pivotal movement when the shutter member is pivotally moved. The shutter member 12 is formed into a substantially C-shape so that the cross section thereof may form an arc in order to obstruct the second pair of conveying rollers 7 and the entrance 16*a* of the conveying path 16 from a vertical direction. The shutter member 12 further has a pushing portion 12*c* to be pushed against the second discharging tray 11 of the openable and closable unit G when the openable and closable unit G is in its closed state. The pushing portion 12*c* is a member for operatively associating the opening and closing of the openable and closable unit G with the opening and closing of the shutter member 12*a* by being pushed against the openable and closable unit G to thereby rotate the shutter member 12. The pushing portion 12*c* is such that the shutter portion 12*a* and the pushing portion 12*c* are integrally disposed so as to extend on opposite sides to the pivot shaft 12*b* with the pivot shaft 12*b* interposed therebetween, and by the opening and closing of the openable and closable unit G, the pushing portion 12*c* is pushed against and spaced apart from the openable and closable unit G.

The length and shape of the shutter portion 12*a* are designed such that when the shutter portion 12*a* is pivotally moved in a clockwise direction as viewed in FIG. 2B, it is retracted from the conveying path 16 of the recording medium P leading to the nip portion 7N between the second pair of conveying rollers 7 (the portion in which the rollers contact with each other). Also, when the shutter portion 12*a* is pivotally moved in a counter-clockwise direction as viewed in FIG. 2B, it covers the conveying path 16 of the recording medium P leading to the nip portion 7N between the second pair of conveying rollers 7 to thereby shelter the entrance 16*a* of the conveying path 16.

By this construction, when the pushing portion 12*c* is pushed toward the interior of the apparatus, the shutter member 12 is pivotally moved about the pivot shaft 12*b* toward the outside of the apparatus (clockwisely as viewed in FIG. 2A). Also, when the pushing portion 12*c* is freed, the shutter member 12*a* is pivotally moved about the pivot shaft 12*b* toward the interior of the apparatus (counter-clockwisely as viewed in FIG. 2B) from gravity.

(Operation of the Shutter Member 12)

By the above-described construction, the operation during the discharge of the recording medium P when the face-up discharge is effected becomes as follows. Description will hereinafter be made with reference to FIGS. 2A and 2B, 4A and 4B, and 5A and 5B.

When the face-down discharge is effected, the openable and closable unit G (conveying guide 10) is brought into a closed state, as shown in FIG. 2A. In this state, the second discharging tray 11 of the openable and closable unit G pushes in the pushing portion 12*c* of the shutter member 12. The shutter member 12 keeps its posture shown in FIG. 2A, whereby the shutter portion 12*a* thereof does not hamper the underside of the nip portion 7N between the second pair of conveying rollers 7 leading to the conveying path 16 of the recording medium P.

Therefore, the shutter portion 12*a* of the shutter member 12 keeps its posture shown in FIG. 2A, whereby it does not protrude to below the nip portion 7N between the second pair of conveying rollers 7 leading to the conveying path 16 of the recording medium P. That is, in a state in which the openable and closable unit G constituted by the second discharging tray 11 and the conveying guide 10 is closed, the shutter member 12 is retracted from the entrance of the conveying path 16. Consequently, it never happens that the shutter member 12 hampers the entry of the recording medium P into the conveying path 16.

Next, when the face-up discharge is to be effected, the openable and closable unit G (conveying guide 10) is brought into an opened state, as shown in FIG. 2B. In this state, the second discharging tray 11 of the openable and closable unit G is spaced apart from the pushing portion 12*c* of the shutter member 12. Consequently, the openable and closable unit G does not push in the shutter member 12 toward the interior side of the apparatus through the pushing portion 12*c*. Therefore, the shutter portion 12*a* of the shutter member 12 protrudes to below the nip portion 7N between the second pair of conveying rollers 7 leading to the conveying path 16 of the recording medium P and therefore, hampers the entry of the recording medium P into the conveying path 16. That is, in a state in which the second discharging tray 11 and the conveying guide 10 constituting the openable and closable unit G are opened, the shutter member 12 obstructs the entrance of the conveying path 16.

As described above, the shutter member 12 is operatively associated with the opening and closing operation of the openable and closable unit G. With the opening and closing of the openable and closable unit G, the shutter member 12 is pivotally moved to a position for obstructing the entrance 16*a* of the conveying path 16 and a position retracted from the entrance 16*a* of the conveying path 16. That is, by the operation of closing the openable and closable unit G, the pushing portion 12*c* abuts against the openable and closable unit G, whereby the shutter member 12 is pivotally moved to the position retracted from the entrance 16*a* of the conveying path 16. By the operation of opening the openable and closable unit G, the pushing portion 12*c* is spaced apart from the openable and closable unit G, whereby the shutter member 12 is pivotally moved from the position for obstructing the entrance 16*a* of the conveying path 16 from gravity.

(Behavior of the Shutter Member 12 and the Recording Medium P During the Conveyance of the Recording Medium P)

Reference is now had to FIGS. 4A, 4B, 5A and 5B to describe the action of the shutter member 12 during the face-up discharge of the recording medium P.

Figure 4A:
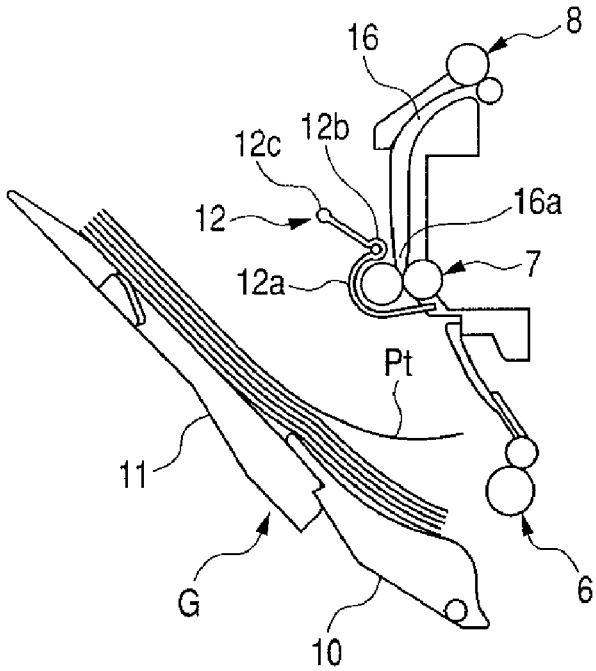
FIGS. 4A and 4B are cross-sectional views of the portions around the openable and closable unit in the first embodiment in the state of face-down discharge.
Figure 4B:
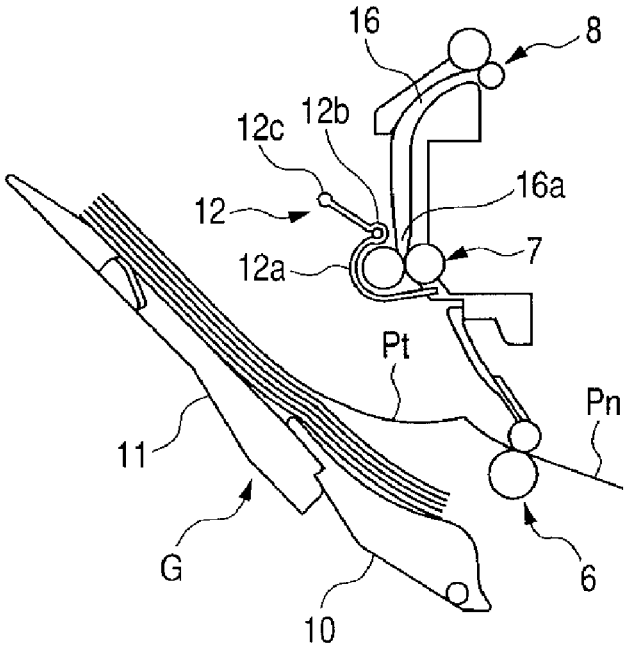
Figure 5A:
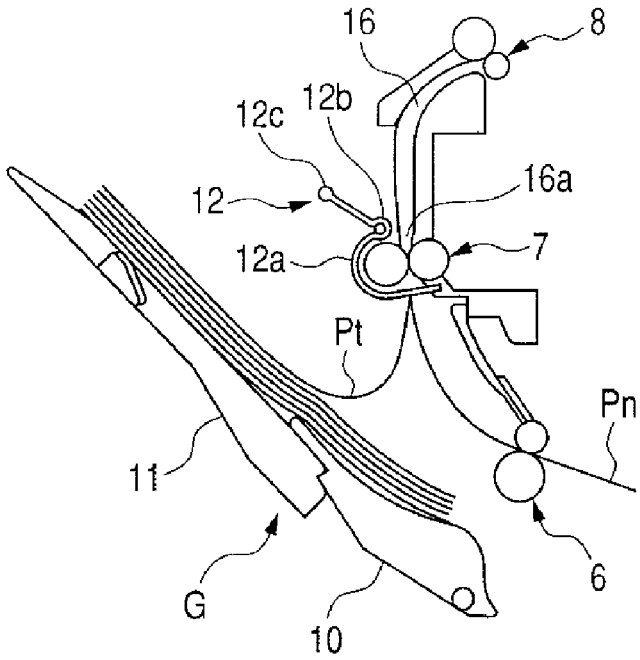
FIGS. 5A and 5B are cross-sectional views of portions around an openable and closable unit in a second embodiment in the state of face-down discharge.
Figure 5B:
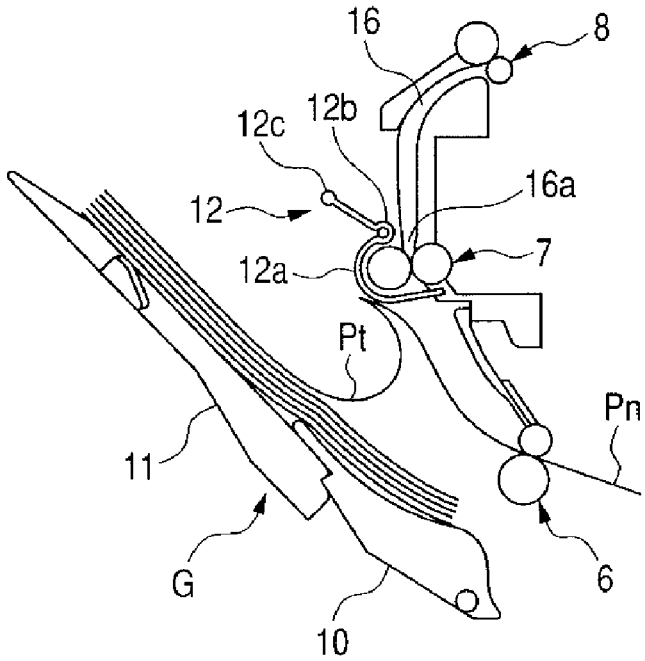

When during the face-up discharge, the recording mediums P are stacked on the second discharging tray 11 and the conveying guide 10 as shown in FIG. 4A, the trailing edge of the uppermost recording medium Pt of the recording mediums P is sometimes upwardly flexed by a change or the like in the ambient environment of the apparatus.

When in the state in which the trailing edge of the recording medium Pt is flexed, a recording medium Pn to be conveyed next to the recording medium Pt is conveyed, the upper portion of the leading edge of the recording medium Pn contacts with the lower portion of the trailing edge of the recording medium Pt in some cases. If in such case, the first pair of conveying rollers 6 intactly continues their conveying operation, the leading edge of the recording medium Pn pushes up the trailing edge of the recording medium Pt.

Even in this case, the nip portion 7N between the second pair of conveying rollers 7 is covered with the shutter portion 12*a* of the shutter member 12. Also, the shutter portion 12*a* is of a construction in which the cross section thereof is substantially C-shaped, and the surface of the lower portion of the shutter portion 12*a* is smoothly formed. Therefore, when the recording medium Pn is conveyed from the first pair of conveying rollers 6, the leading edge portion of the recording medium Pn goes toward the second discharging tray 11 while the trailing edge of the recording medium Pt is pushed by the surface of the lower portion of the shutter portion 12*a*. Thus, the trailing edge of the recording medium Pt and the leading edge of the recording medium Pn conveyed by the first pair of conveying rollers 6 are conveyed along the shutter portion 12*a* of the shutter member 12 toward the second discharging tray 11. As the result, the recording mediums P are stacked on the second discharging tray 11 and the conveying guide 10 in good order.

As described above, when the face-up discharge is to be effected, the shutter portion 12*a* of the shutter member 12 covers and thereby obstructs the second pair of conveying rollers 7 and the entrance 16*a* of the conveying path 16, in operative association with the operation of opening the openable and closable unit G. Thereby, even if the trailing edge of the recording medium Pt or the leading edge of the recording medium Pn is moved to the conveying path 16 side, the recording medium P only contacts with the lower portion of the shutter member 12, and does not pass through the nip portion 7N between the second pair of conveying rollers 7 into the conveying path 16. Further, the underside of the shutter portion 12*a* guides the contacting recording medium P to the second discharging tray 11 side. Accordingly, the recording medium P can be smoothly conveyed.

Even if, for example, in the state in which the openable and closable unit G is opened, the uppermost recording medium of the recording mediums stacked on the second discharging tray 11 and the conveying guide 10 is flexed and discharged with a result that the trailing edge of the uppermost recording medium and the leading edge of a recording medium conveyed next thereto go toward the conveying path 16 while being in contact with each other, the shutter member 12 obstructs the conveying path 16. Therefore, the trailing edge of the uppermost recording medium and the leading edge of the recording medium conveyed next thereto are not guided into the conveying path 16, but these recording mediums are discharged along the underside of the shutter member 12 onto the opened openable and closable unit G.

Also, the shutter member 12 in the present embodiment is pivotally moved from gravity when the openable and closable unit G is opened. Thus, without the apparatus being made complicated, the obstruction of the entrance of the conveying path 16 can be effected by the opening of the openable and closable unit G, and the shutter member 12 can be made small. Also, the size of the discharging portion of the apparatus near the recording medium P can be made small.

Also, when the face-up discharge is to be effected with the openable and closable unit G opened, the shutter portion 12*a* covers the nip between the second pair of conveying rollers 7. Therefore, when for example, the user attempts to adjust the posture of the discharged recording medium Pn when the recording medium Pn is being discharged from the first pair of conveying rollers 6, the user is prevented from inadvertently touching the second pair of controlling rollers 7, or from making the discharged recording medium or the like touch the second pair of conveying rollers 7 by mistake to thereby damage the recording medium or the second pair of conveying rollers 7.

Also, the pivot shaft 12*b* of the shutter member 12 is provided above the roller of the second pair of conveying rollers 7 which is on the outer side of the apparatus, or outside the conveying path 16, and is provided at a location nearer to the second discharging tray 11. In the present embodiment, it is preferable that the biasing of the pushing portion 12*c* against the second discharging tray 11 be effectively effected, and by the pivot shaft 12*b* being provided more outside the apparatus, the biasing of the pushing portion against the second discharging tray 11 can be effected simply and effectively.

Second Embodiment

A second embodiment of the present invention will now be described with reference to the drawings. Members similar in construction to those in the aforedescribed embodiment are given the same reference characters and need not be described. In the present embodiment, detailed description will be made of a plate 15 which is a characteristic portion.

(Construction of the Plate 15)

The plate member (obstructing member) 15 for smoothing the conveyance of the recording medium P onto the openable and closable unit G during the face-up discharge will hereinafter be described in detail with reference to the drawings. FIGS. 6A and 6B, FIGS. 8A and 8B, and FIGS. 9A and 9B are cross-sectional views of portions around the openable and closable unit G in the second embodiment in the face-down discharge state, and FIG. 7 is a fragmentary perspective view showing the plate member 15 located near the entrance 16*a* of the conveying path 16 in the second embodiment.

As shown in FIGS. 6A, 6B, 7A and 7B, the plate member 15 in the present embodiment has a plate portion (obstructing) portion 15*b* disposed so as to be capable of covering the second pair of conveying rollers 7 and the entrance 16*a* of the conveying path 16 to thereby obstruct the conveying path 16, a pushing portion 15*a* constructed integrally with the plate portion 15*b* and disposed at a position which does not hamper the conveying path 16 and pushed against the second discharging tray 11 of the openable and closable unit G in a state in which the openable and closable unit G is closed, and a spring 15*c* as a urging portion to provide an urging force in a direction in which the plate portion 15*b* biases and extends in accordance with the opening of the second discharging tray 11 side by the second discharging tray 11 side being opened.

Thereby, when the pushing portion 15*a* is pushed in a direction in which the second discharging tray 11 side is closed, the plate portion 15*b* shrinks against the urging force of the spring 15*c*, and the plate portion 15*b* is horizontally moved to the inside of the apparatus. Also, when the pushing portion 15*a* is freed, the plate portion 15*b* is horizontally moved from the inside toward the outside of the apparatus by the urging force of the spring 15*c*, as shown in FIG. 6. As the result, the plate portion 15*b* covers and thereby shelter the second pair of conveying rollers 7 and the conveying path 16.

(Operation of the Plate Member 15)

By the above-described construction, the operation during the discharge of the recording medium P when the face-up discharge is effected becomes as follows. Description will hereinafter be made with reference to FIGS. 6A, 6B, 8A, 8B, 9A and 9B.

Figure 6A:
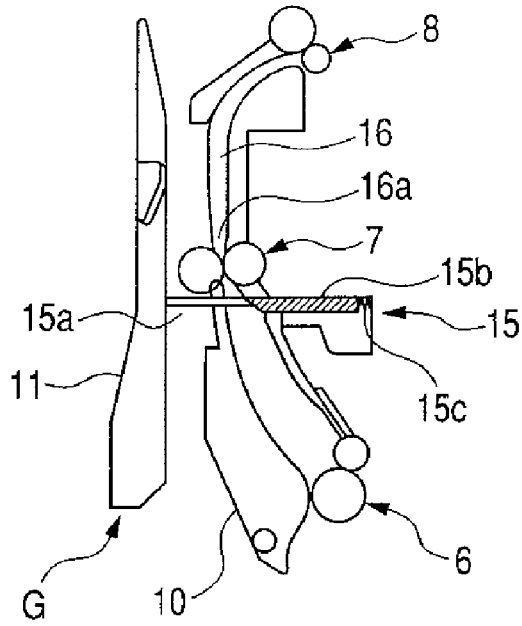
FIG. 6A is a cross-sectional view of the portions around the openable and closable unit in the second embodiment in the state of face-down discharge.
Figure 7:
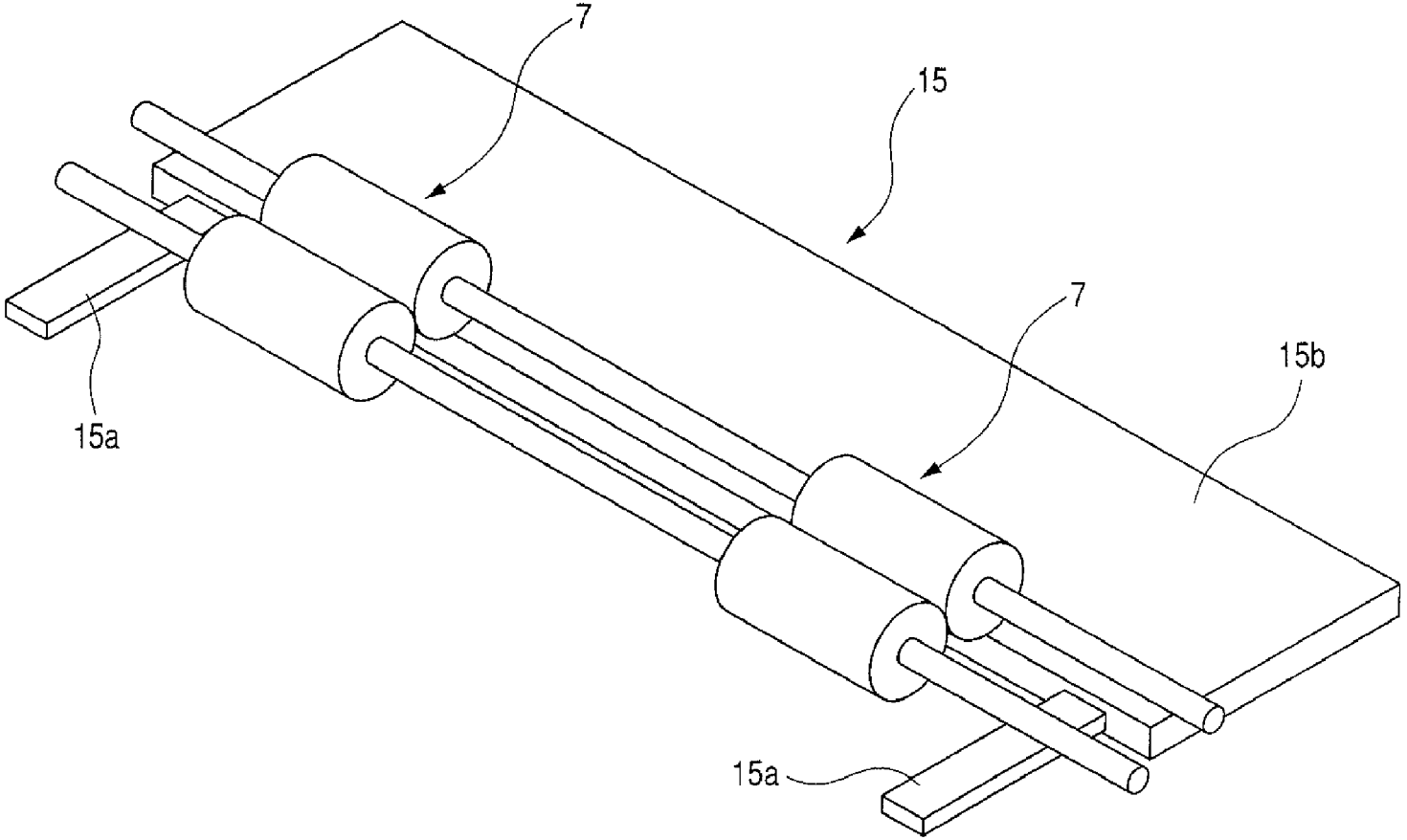
FIG. 7 is a fragmentary perspective view showing a plate member 15 located near the entrance of a conveying path in the second embodiment.

First, when the face-down discharge is to be effected, the openable and closable unit G is brought into a closed state, as shown in FIG. 6A. In the state in which the openable and closable unit G is closed, the second discharging tray 11 pushes the pushing portion 15*a* of the plate member 15 toward the interior of the apparatus. The plate portion 15*b* of the plate member 15 is pushed into the interior side against the urging force of the plate member 15 and thus, the plate portion 15*b* maintains its posture retracted from below the nip portion 7N between the second pair of conveying rollers 7 leading to the conveying path 16 of the recording medium P. The pushing portion 15*a* is disposed outside the conveying path 16. Therefore, the plate portion 15*b* of the plate member 15 does not protrude to below the nip portion 7N between the second pair of conveying rollers 7 leading to the conveying path of the recording medium P, and does not hamper the conveyance of the recording medium P.

Figure 6B:
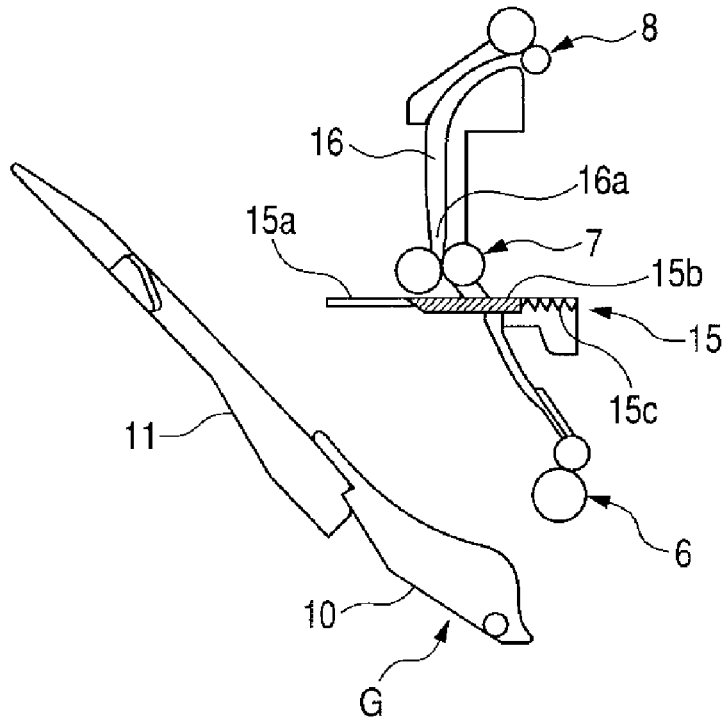
FIG. 6B is a cross-sectional view of the portions around the openable and closable unit in the second embodiment in the state of face-up discharge.

Next, when the face-up discharge is to be effected, the openable and closable unit G is brought into an opened state, as shown in FIG. 6B. In the state in which the openable and closable unit G is opened, the second discharging tray 11 of the openable and closable unit G is spaced apart from the pushing portion 15*a* of the plate member 15, and the pushing portion 15*a* so far pushed into the interior side of the apparatus becomes free. The plate portion 15*b* is horizontally moved from the inside to the outside of the apparatus by the urging force of the spring 15*c*, and extends to below the nip portion 7N between the second pair of conveying rollers 7 leading to the conveying path of the recording medium P. Therefore, the plate portion 15*b* of the plate member 15 protrudes to below the nip portion 7N between the second pair of conveying rollers 7 leading to the conveying path 16 of the recording medium P and thus, the plate portion 15*b* hampers the entry of the recording medium P into the conveying path 16.

As described above, the plate member 15 is operatively associated with the opening and closing operation of the openable and closable unit G. With the opening and closing of the openable and closable unit G, the plate member 15 is moved to a position for obstructing the entrance 16*a* of the conveying path 16 and a position retracted from the entrance 16*a* of the conveying path 16. That is, by the operation of closing the openable and closable unit G, the pushing portion 15*a* abuts against the openable and closable unit G, whereby the plate member 15 is moved to the position retracted from the entrance 16*a* of the conveying path 16 against the urging force of the spring 15*c*. By the operation of opening the openable and closable unit G, the openable and closable unit G and the pushing portion 15*a* are spaced apart from each other, whereby the plate member 15 is moved to the position for obstructing the entrance 16*a* of the conveying path 16 by the urging force of the spring 15*c*.

(Behavior of the Plate Member 15 and the Recording Medium P During the Conveyance Thereof)

Reference is now had to FIGS. 8A, 8B, 9A and 9B to describe the action of the plate member 15 during the face-up discharge of the recording medium P.

Figure 8A:
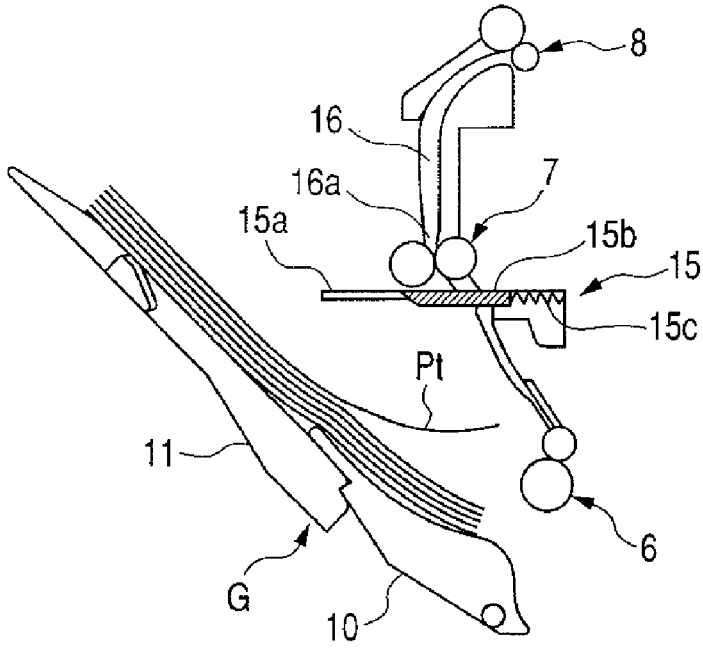
FIGS. 8A and 8B are cross-sectional views of the portions around the openable and closable unit in the second embodiment in the state of face-up discharge.
Figure 8B:
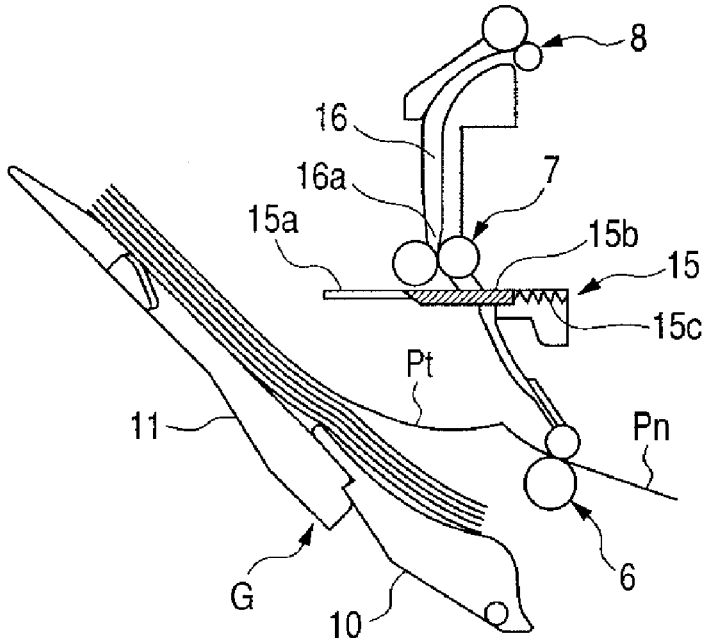
Figure 9A:
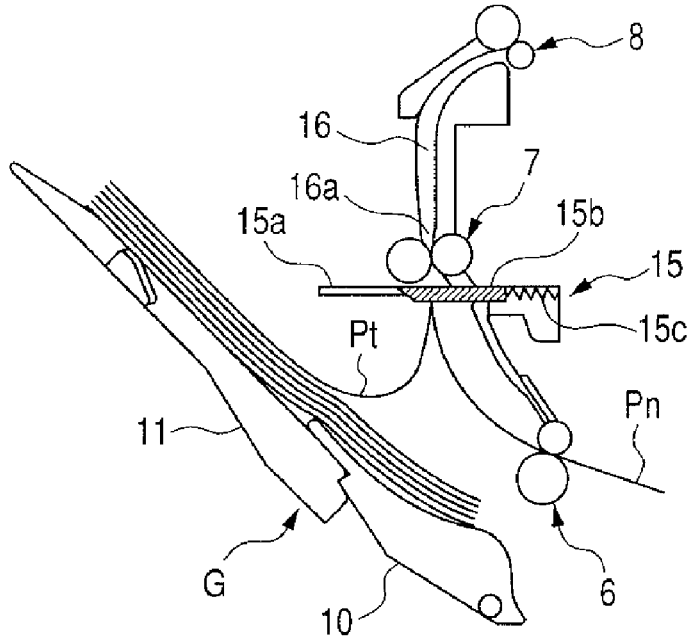
FIGS. 9A and 9B are cross-sectional views of the portions around the openable and closable unit in the second embodiment in the state of face-up discharge.
Figure 9B:
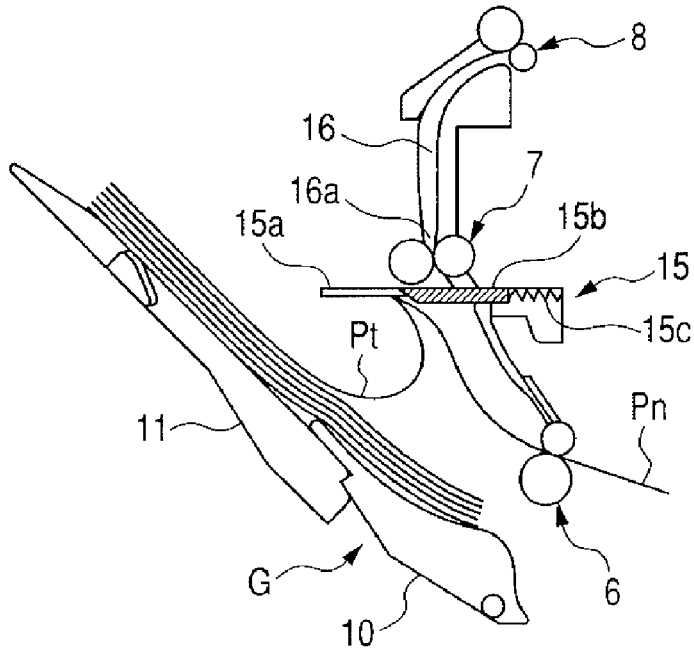

When during the face-up discharge, the recording mediums P are stacked on the openable and closable unit G (on the second discharging tray 11 and the conveying guide 10), it sometimes happens that as shown in FIG. 8A, the trailing edge of the uppermost recording medium Pt of the stacked recording mediums P is upwardly flexed by a change or the like in the ambient environment of the apparatus.

When with the trailing edge of the recording medium Pt upwardly flexed, a recording medium Pn to be conveyed next to the recording medium Pt is conveyed, as previously described, the leading edge of the recording medium Pn pushes up the trailing edge of the recording medium Pt, as shown in FIG. 8A.

Even in this case, the nip portion 7N between the second pair of conveying rollers 7 is covered with the plate portion 15*b* of the plate member 15. Also, the plate portion 15*b* is of a flat plate-like construction, and the surface of the lower portion of the plate portion 15*b* is formed smoothly. By such a construction, when the recording medium Pn is conveyed from the first pair of conveying rollers 6, the leading edge portion of the recording medium Pn goes toward the second discharging tray 11 while pushing the trailing edge of the recording medium Pt by the surface of the lower portion of the plate portion 15*b*. Thus, the trailing edge of the recording medium Pt and the leading edge of the recording medium Pn conveyed by the first pair of conveying rollers 6 are conveyed toward the second discharging tray 11 along the underside of the plate portion 15*b* of the plate member 15. As the result, the recording mediums P are stacked on the conveying guide 10 and the second discharging tray 11 in good order.

As described above, when the face-up discharge is to be effected, the plate portion 15*b* of the plate member 15 covers and thereby obstructs the second pair of conveying rollers 7 and the conveying path 16 in operative association with the operation of opening the openable and closable unit G. Thereby, even if the trailing edge of the recording medium Pt and the leading edge of the recording medium Pn are moved to the conveying path 16 side, the recording mediums only contact with the underside of the plate member 15, and do not pass through the nip portion 7N between the second pair of conveying rollers 7 into the conveying path 16. Also, the underside of the plate portion 15*b* guides the contacting recording mediums P to the second discharging tray 11 side. Therefore, the recording mediums P can be conveyed smoothly.

Also, the plate portion 15*b* of the plate member 15 is provided more inside than the inner roller of the second pair of conveying rollers 7 with respect to the apparatus and the conveying path 16. Therefore, it can also be applied to a compact apparatus such as one in which a sufficient space is absent outside the conveying path 16.

Also, when the face-up discharge is to be effected, the plate portion 15*b* covers the nip between the second pair of conveying rollers 7. Therefore, when for example, the user attempts to adjust the posture of the discharged recording medium Pn when the recording medium Pn is being discharged from the first pair of conveying rollers 6, the user is prevented from touching the second pair of conveying rollers 7 by mistake, or making the discharged recording medium or the like touch the second pair of conveying rollers 7 by mistake to thereby damage the recording medium or the second pair of conveying rollers 7.

Other Embodiments

Figure 10A:
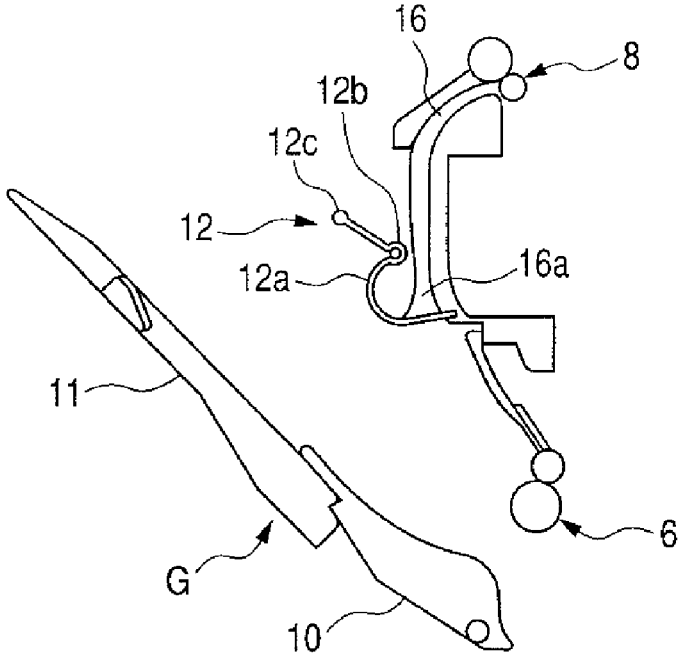
FIGS. 10A and 10B are cross-sectional views of portions around an openable and closable unit in another embodiment in face-up discharge.
Figure 10B:
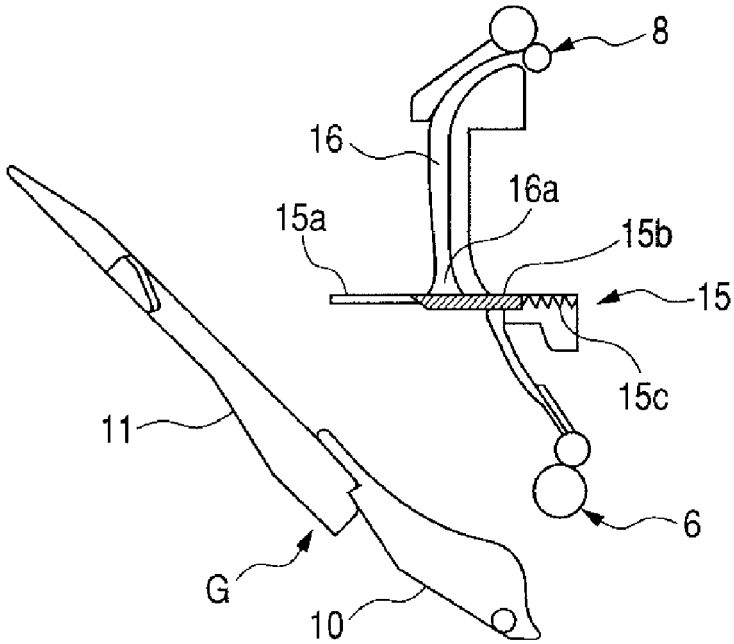
Figure 11A:
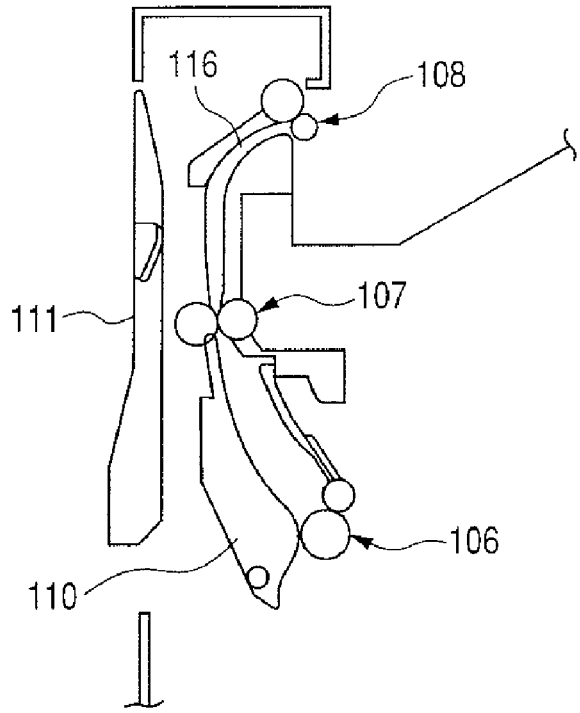
FIG. 11A is a cross-sectional view of portions around a tray in the prior art in face-down discharge.
Figure 11B:
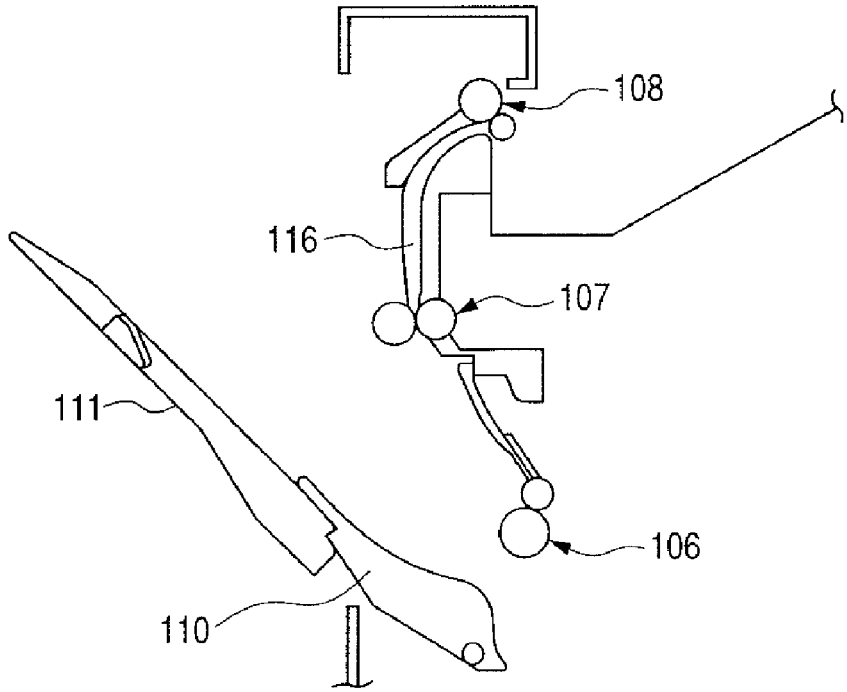
FIG. 11B is a cross-sectional view of the portions near the tray in the prior art in the state of face-up discharge.
Figure 12A:
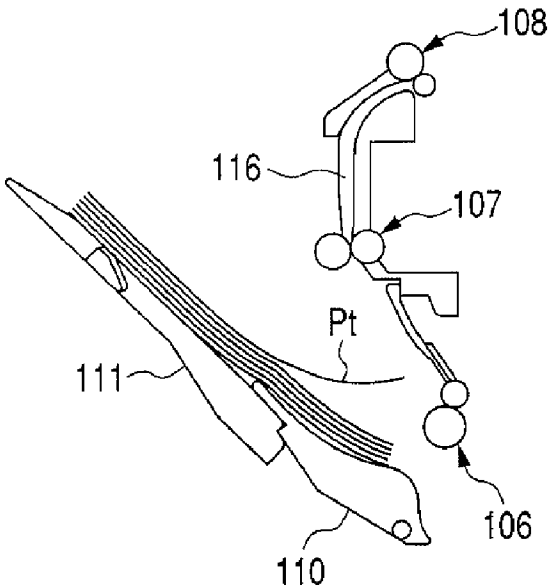
FIGS. 12A, 12B and 12C are cross-sectional views of portions around a discharging tray in the prior art in the state of face-up discharge.
Figure 12B:
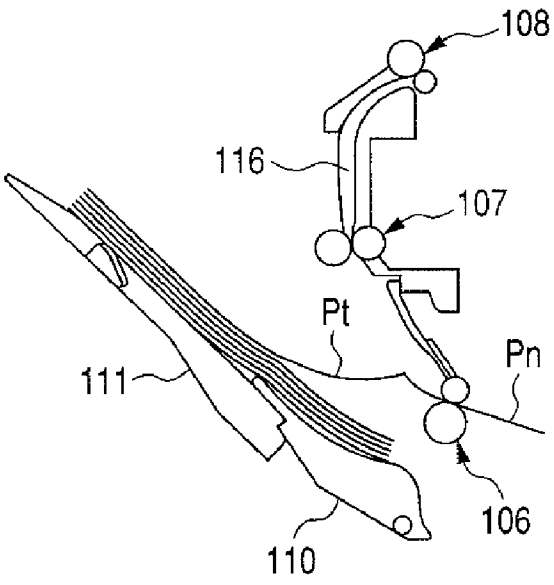
Figure 12C:
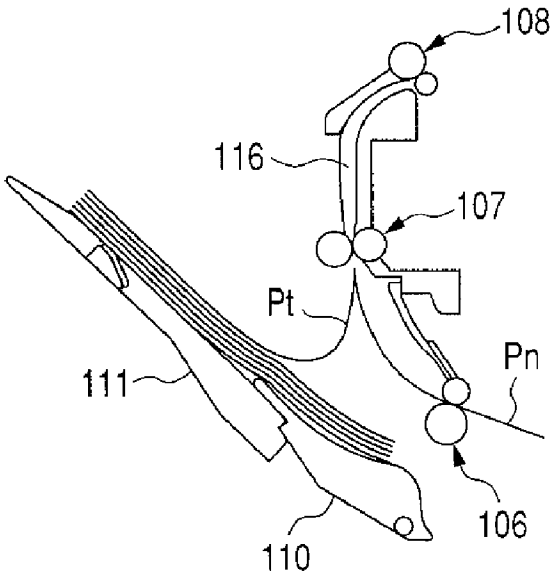

In the aforedescribed embodiments, there has been shown by way of example a construction in which there are provided two pairs of rollers (the second pair of conveying rollers 7 and the pair of discharging rollers 8) for conveying the recording medium P in the conveying path 16 to the first discharging tray 9. However, this is not restrictive. For example, there can also be applied a construction in which as shown in FIGS. 10A and 10B, the second pair of conveying rollers 7 are not disposed but only the pair of discharging rollers 8 are disposed. That is, there may be adopted a construction in which as shown in FIG. 10A, the lower portion of the conveying path 16 is obstructed by the shutter portion 12*a*, or a construction in which as shown in FIG. 10B, the lower portion of the conveying path 16 is obstructed by the plate portion 15*b*.

As described above, when the openable and closable unit G is opened when the face-up discharge is to be effected, the entrance 16*a* of the conveying path 16 is covered with the obstructing portion (the shutter portion 12*a* and the plate portion 15*b*) of the obstructing member (the shutter member 12 and the plate member 15) in operative association with this operation. Thereupon, the trailing edge of the recording medium Pt and the leading edge of the recording medium Pn contact with the lower portion of the obstructing portion, whereafter these recording mediums are conveyed toward the second discharging tray 11. As the result, the recording mediums P are stacked on the openable and closable unit G in good order. Also, this embodiment is of a construction in which the second pair of conveying rollers 7 are not disposed, but only one pair of discharging rollers 8 are disposed at the most downstream end of the conveying path 16 and therefore, can make the apparatus more compact.

While in the aforedescribed embodiments, the shutter member is moved from gravity or by the spring, this is not restrictive. For example, design may be made such that the shutter portion is moved not by gravity or the spring, but is electrically moved by the use of a drive source such as a motor.

While in the aforedescribed embodiments, description has been made with a printer shown as the image forming apparatus, this is not restrictive. The present invention can also be applied, for example, to a copying machine, a facsimile apparatus, etc.

This application claims priority from Japanese Patent Application No. 2005-053582 filed on Feb. 28, 2005, which is hereby incorporated by reference herein.

What is claimed is:

1. A sheet conveying apparatus comprising:

a pair of first conveying rotary members configured to convey a sheet;

an openable and closable conveying guide configured to guide the sheet conveyed by said pair of first conveying rotary members;

a pair of second conveying rotary members configured to convey a sheet guided by said openable and closable conveying guide; and an obstructing member having a curved portion, said obstructing member positioned at a first position in a state in which said openable and closable conveying guide is closed and at a second position in a state in which said openable and closable conveying guide is opened, wherein when the obstructing member is positioned at the first position, the obstructing member allows the sheet conveyed by said pair of first conveying rotary members to come into the nip portion of said pair of second conveying rotary members and, when the obstructing member is positioned at the second position, the obstructing member obstructs an entrance to the nip portion of said pair of second conveying rotary members to convey the sheet outside of a main body of said sheet conveying apparatus and wherein when said obstructing member is positioned at the second position, said obstructing member contains a second conveying rotary member on said openable and closable conveying guide side among said pair of second conveying rotary members, in the curved portion of said obstructing member.

2. A sheet conveying apparatus according to claim 1, wherein in the state in which said openable and closeable conveying guide is opened, the sheet conveyed by said pair of first conveying rotary members is stacked on said openable and closable conveying guide.

3. A sheet conveying apparatus according to claim 1, wherein said obstructing member further has a pivot shaft providing the center of pivotal movement, and said pivot shaft of said obstructing member is disposed more outside an apparatus main body than the nip portion of said pair of second conveying rotary members.

4. A sheet conveying apparatus according to claim 1, wherein said openable and closable conveying guide is disposed on an openable and closable unit, wherein said obstructing member further has a contacted portion contacted against said openable and closable unit in the state in which said openable and closable unit is closed, and a pivot shaft, and by the operation of closing said openable and closable unit, said openable and closable unit and said contacted portion come into contact with the openable and closable unit, whereby said obstructing member is pivotally moved to the second position from the first position.

5. A sheet conveying apparatus according to claim 1, wherein said openable and closable conveying guide is disposed on an openable and closable unit, wherein said obstructing member is provided with a contacted portion contacted against and spaced apart from said openable and closable unit, wherein the contacted portion associates the moving of said obstructing member with the opening and closing of said openable and closable unit.

6. A sheet conveying apparatus according to claim 1, wherein said obstructing member positioning at the second position covers at least a part of the peripheral surface of one of said pair of second conveying rotary members, the one of said pair of second conveying rotary members is disposed on a side of the outside of the main body, and at least a part of the peripheral surface covered by said obstructing member is a portion being positioned on a side opposite to the nip portion of the one of said pair of second conveying rotary members.

7. An image forming apparatus comprising:

an image forming portion for forming an image on a sheet; and a sheet conveying apparatus according to claim 1, wherein said sheet conveying apparatus conveys the sheet on which the image has been formed by said image forming portion.

* * * * *